US007137368B2

(12) United States Patent
Schön et al.

(10) Patent No.: US 7,137,368 B2
(45) Date of Patent: Nov. 21, 2006

(54) DEVICE FOR VARIABLE ACTUATION OF THE GAS EXCHANGE VALVES IN INTERNAL COMBUSTION PISTON ENGINES

(75) Inventors: Helmut Schön, Frastanz (AT); Peter Kuhn, Weinheim (DE)

(73) Assignee: Fraunhofer Gesselschaft zur Förderung der Angewandten Forschung e. V., München (DE)

( * ) Notice: Subject to any disclaimer, the term of this patent is extended or adjusted under 35 U.S.C. 154(b) by 5 days.

(21) Appl. No.: 10/499,187

(22) PCT Filed: Dec. 19, 2002

(86) PCT No.: PCT/DE02/04666

§ 371 (c)(1),
(2), (4) Date: Oct. 4, 2004

(87) PCT Pub. No.: WO03/054362

PCT Pub. Date: Jul. 3, 2003

(65) Prior Publication Data

US 2005/0028765 A1 Feb. 10, 2005

(30) Foreign Application Priority Data

Dec. 20, 2001 (DE) ..... 101 62 797

(51) Int. Cl.
*F01L 1/34* (2006.01)

(52) U.S. Cl. ..... 123/90.16; 123/90.39; 123/90.44

(58) Field of Classification Search ..... 123/90.16, 123/90.2, 90.39, 90.44, 90.6; 74/559, 569
See application file for complete search history.

(56) References Cited

U.S. PATENT DOCUMENTS 5,119,773 A 6/1992 Schon et al. ..... 123/90.16
5,159,852 A * 11/1992 Harimoto ..... 74/559
5,189,998 A * 3/1993 Hara ..... 123/90.16

FOREIGN PATENT DOCUMENTS

| | | |
|---|---|---|
| DE | 26 29 554 | 1/1978 |
| DE | 38 33 540 | 4/1990 |
| DE | 42 23 172 | 8/1993 |
| DE | 43 22 449 | 2/1995 |
| DE | 100 31 783 | 1/2002 |
| DE | 101 62 797 | 7/2003 |
| WO | WO 03/054362 | 7/2003 |

* cited by examiner

OTHER PUBLICATIONS

Berg, M. et al.: "Delta-St ein neues Getriebe zur variablen Ventilsteuerung in Hubkolbenmotoren", Oct. 1992, Stuttgart, Germany.

*Primary Examiner*—Thomas Denion
*Assistant Examiner*—Ching Chang
(74) *Attorney, Agent, or Firm*—Baker & Daniels

(57) ABSTRACT

The invention relates to a revolving gear consisting of a housing (G), a shaft (W), an intermediate member (Z) and an output member (A). The shaft is revolvably guided in the housing in a rotating joint (wb) and actuates the intermediate member by means of a curved joint (zw). The intermediate member is supported by a curved joint (zg) in the housing and is actively connected to the output member by another curved joint (za). The curved joint between the intermediate member and the housing has a controlling section enabling movement to be transmitted to the output member and a locking section preventing movement from being transmitted to the output member. The output member is unequivocally guided in the housing and transmits movement to at least one valve (V).

20 Claims, 6 Drawing Sheets

DEVICE FOR VARIABLE ACTUATION OF THE GAS EXCHANGE VALVES IN INTERNAL COMBUSTION PISTON ENGINES

It is known that the travel path of the gas exchange valves in internal combustion engines has a decisive influence on the operating performance and the performance data of the motor. In particular for the reduction of gas-exchange losses in charge-mass-controlled motors, a valve travel path that can be constantly changed in the operation of the motor is preferable. Thereby, a change in the travel path from intake and exhaust valves as well as a change only in the intake valves can be advantageous. Four-element gear boxes (e.g. DE 38 33 540 C2, DE 43 22 449 A1, BMW Valvetronic) is known for the technical implementation of such variable valve control. Such valve gear boxes enable an uninterrupted change in the valve travel path during the operation of a motor.

The goal of the invention is to fulfill the requirements set by the motor for a variable valve control better than the state of the art. These requirements are characterized for one in the design of the individual valve travel paths and secondly in the size of the mechanical loss through friction during the actuation of the valves. The individual valve travel paths and the producible host of valve travel paths must be as freely constructed as possible with respect to the aperture angle, closure angle, valve stroke, valve acceleration course, and phasing to the crank angle. Losses due to mechanical friction should be kept to a minimum. These requirements should be fulfilled to the greatest extent possible without additional constructional effort, in particular an increase in overall height.

This goal is fulfilled through the characteristics of a gear box for the actuation of the valves.

FIGS. 1–10 are cross-sectional views illustrating various embodiments of the invention.

The gear box consists of an actuating shaft (W), which is revolvably guided in the housing (G) in a swivel joint (wg) and which actuates an intermediate member (Z) via a curved joint (zw). This intermediate member (Z) is supported for one by a curved joint (zg) in the housing (G), for example in the cylinder head and is connected with an output member (A). The curved joint (zg) between the intermediate member (Z) and the housing (G) consists of a locking section and a controlling section. For changing the valve stroke, it is provided to design in a changeable manner the position (a) of the controlling section to the curved joint (zg) of the shaft (W) in the housing (G) in the motor operation. The output member (A) is clearly guided in the housing (G), for example in a curved joint (ag), and transmits the movement to at least one valve (V).

The advantages gained with the invention result from the fact that the intermediate member (Z) is connected with the output member (A) via a curved joint (za), thereby reducing the number of joint valences on the intermediate member actuated by the shaft (W) and simultaneously the total number of joint valences of the gear box. Contrary to the known state of the art, the gear box has an additional degree of freedom of movement, which allows a displacement of the intermediate member (Z) relative to the output member (A) along the cam of the curved joint (za) between the intermediate member (Z) and the output member (A) and a simultaneous rotation of the intermediate member (Z) relative to the output member (A) around the curved joint (za) between the intermediate member (Z) and the output member (A). With the curved joint (za) in accordance with the invention that is between the intermediate member (Z) and the output member (A), the movement of the intermediate member (Z) and thus the movement transmission from the actuating shaft (W) to the output member (A) and thus to the valve (V) can be designed with more freedom that with the state of the art.

The additional degree of movement freedom causes a roll. i.e. rocking, motion of the intermediate member (Z) on the output member (A). This rotary motion causes a displacement flow of the lubricant, which supports significantly the formation of a sustainable lubricating film in the contact of intermediate member (Z) and output member (A). The rotary motion also partially reduces the sliding speed in the contact point through a roll motion. Each of these effects reduces the friction in the named contact point. The design in accordance with the invention also has the advantage that it does not require more space compared to the state of the art.

An advantageous design is where the contour (Kza or Kaz) of one of the two contact partners in the curved joint (za) between the intermediate member (Z) and the output member (A) is a level surface.

The production of the components is therefore less expensive and more exact than with the freely designed contour of both gear members.

The contour (Kaz or/and Kza) of at least one of the two contact partners in the curved joint (za) between the intermediate member (Z) and the output member (A) may be a circular arc. The production of the component is therefore less expensive and more exact than with the freely designed contour of the gear members.

FIGS. 2–5 show advantageous designs of the curved joints.

By designing the curved joint such that the curved-joint-determining contour is only attached to the one contact partner, the contour of the other contact partner will be a circular arc or a circle, which is preferably designed as a revolvable cable roll. Thereby, in this curved joint, a rolling off of the contact partner on the curved-joint-determined form is achieved and the tangential movement is shifted to the bearing of the revolvable cable roll. The friction in this curved joint is reduced through the materials known for slide bearings and lubrication ratios and through the use of a small friction radius.

The friction of the gear box may be further reduced through the use of various friction-reducing effects in the curved joint on the intermediate member (Z).

The friction in the curved joints on the intermediate member (Z) may be further reduced through the use of an anti-friction bearing for supporting a revolvable cable roll.

Figure 1:
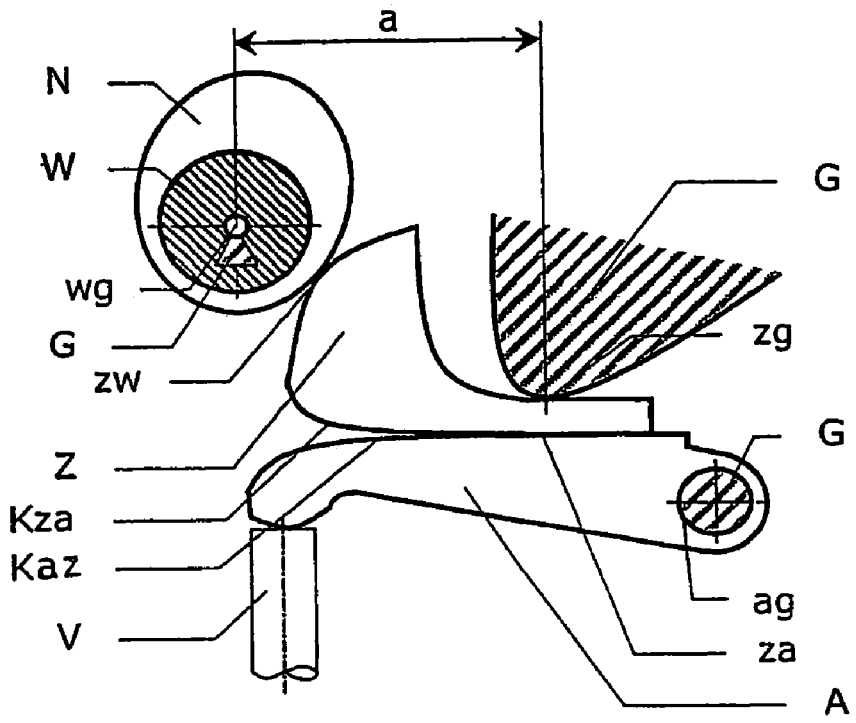
Figure 2:
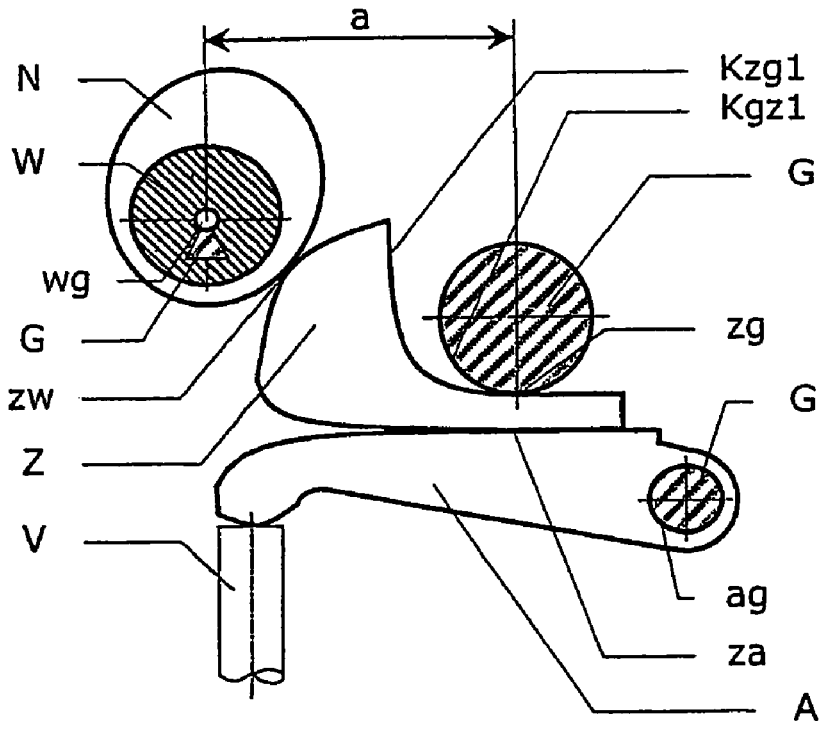
FIG. 2 illustrates an embodiment of the gear box in which the curved-joint-determining contour of the curved joint (zg) between the intermediate member (Z) and the housing (G) is formed exclusively by the contour (Kzg1) on the intermediate member (Z) and in which the contour (Kgz1) of the housing-side support is a revolvable cable roll.
Figure 3:
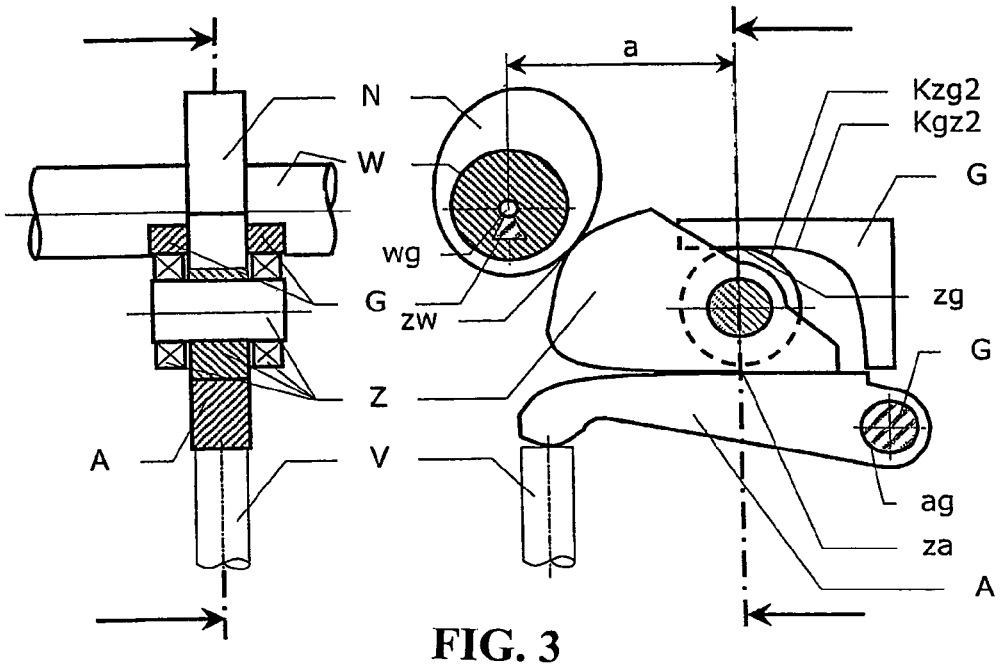
FIG. 3 shows an embodiment of the gear box, in which the curved-joint-determining contour of the curved joint (zg) between the intermediate member (Z) and the housing (G) is formed exclusively by the contour (Kgz2) on the housing (G) and the curved-joint-determining contour (Kzg2) is a revolvable cable roll.
Figure 4:
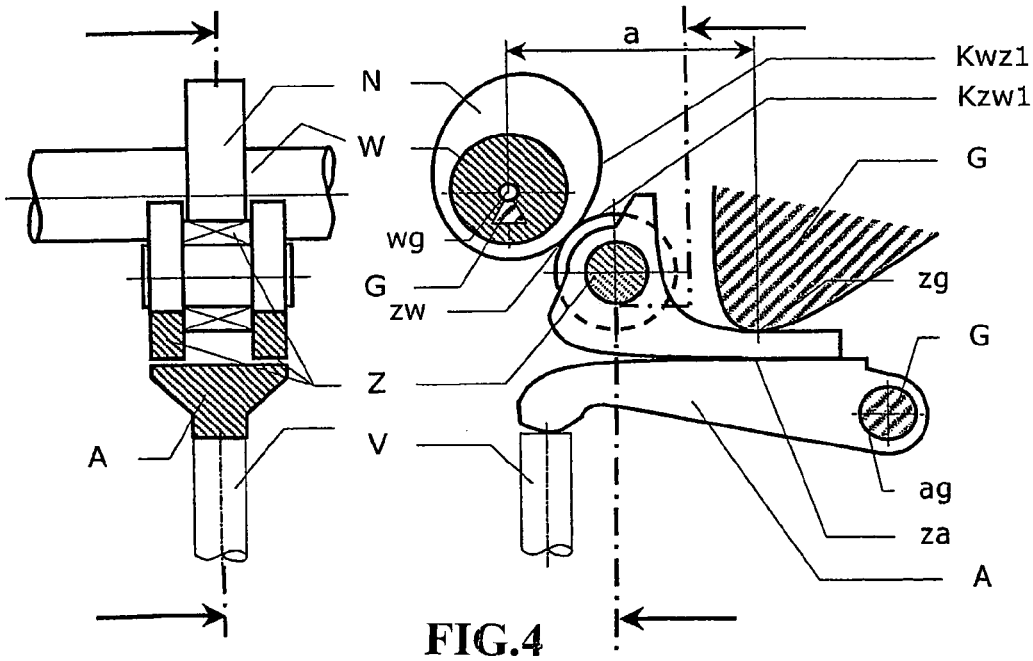
FIG. 4 illustrates an embodiment of the gear box, in which the curved-joint-determining contour of the curved joint (zw) between the intermediate member (Z) and the shaft (W) is formed exclusively by the contour (Kwz1) on the shaft (W) and the curved-joint-determining contour (Kzw1) is a revolvable cable roll.
Figure 5:
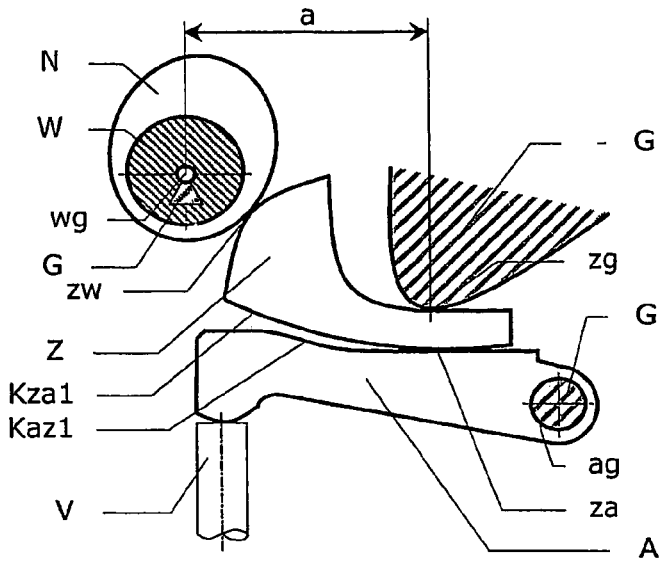
FIG. 5 illustrates an embodiment of the gear box, in which the curved-joint-determining contour of the curved joint (za) between the intermediate member (Z) and the output member (A) is formed exclusively by the contour (Kaz1) on the output member (A) and the curved-joint-determining contour (Kza1) is a circular arc or a revolvable cable roll.
Figure 6:
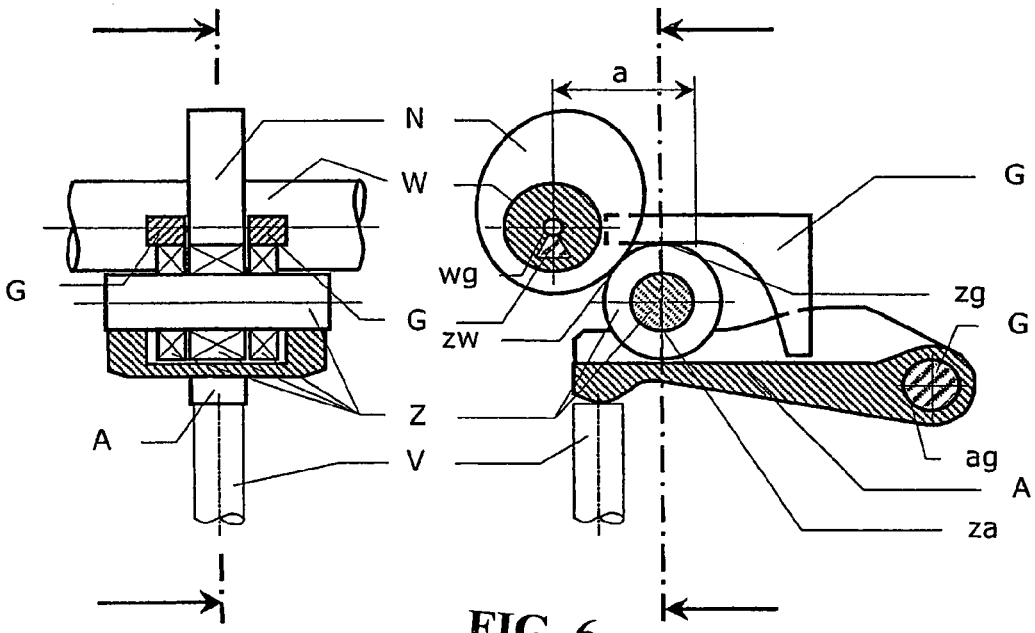

FIG. 6 shows the advantageous design of the intermediate member (Z), in which at least two of the curved joints on the intermediate member (Z) are represented on the intermediate member side through rotating bodies and at least two of the rotating centers of these rotating bodies overlap. In this manner, the designed space is minimized and the power resulting from the angular acceleration of the intermediate member (Z) is reduced. In an extreme case, all three curved joints on the intermediate member (Z) are represented on the intermediate side through rotating bodies and all three rotating centers overlap. In this manner, the smallest designed space requirement is attained. The pivot position of the intermediate member (Z) as a degree of freedom of movement freedom is then meaningless for the transmission of movement.

Figure 7:
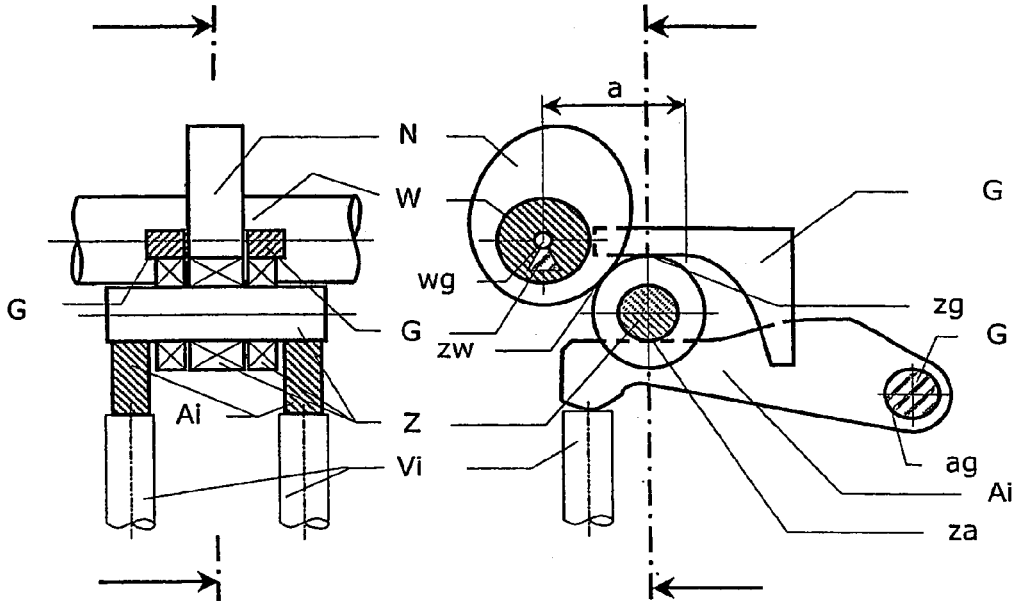

FIG. 7 shows that the number of joints and the moved masses can be reduced through a joint actuation of several output members (Ai) and valves (Vi) of a cylinder via a cam (N) and an intermediate member (Z), which advantageously reduces the friction and minimizes the constructional effort through the reduction of the number of components.

Figure 8:
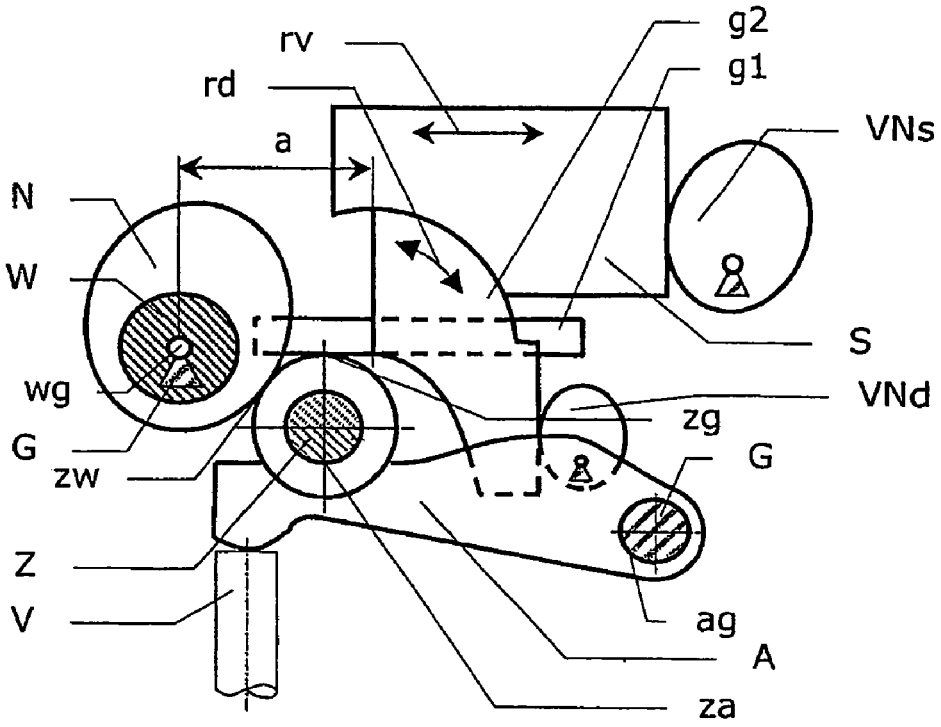

FIG. 8 shows the curve (Kgz2) forming the curved joint (zg) between the intermediate member (Z) and the housing (G) in the housing (G) consisting of a part (g1) forming the valve locking section and a part (g2) forming the controlling section. As an example, the part (g2) forming the controlling section can be affixed in a revolvable manner in a push part (S) and the push part (S) can be affixed in the housing (G) in a relocatable manner. The displacement position (rs) of the push part (S) can, for example, be set through a cam (VNs) clamped in the housing (G). The rotary motion (rd) of the part (g2) forming the controlling section can be set through a cam (VNd) clamped in the housing (G) or through a cam (VNd) clamped in the push part (S). In this manner, the rotary motion (rd) of the part (g2) forming the controlling section can be set independently of the displacement position (rs) of the push part (S). In the simplest case, the rotary motion (rd) is controlled by a cam located in the housing (G) through the displacement (rs) of the push part (S). In this way, the position (a) of the radial cam in the direction of the locking section can be implemented in a displaceable (rv) and rotatable (rd) manner in order to modify the valve cam. This further increases the design freedom of the valve cam. A contact loss of the gear members does not occur. In particular, the valve acceleration and the valve stroke can also be modified with the same valve opening angle.

The part (g1) forming the locking section in the housing (G) can be used to guarantee the reset movement of the intermediate member (7) and thus the cam contact, in that it is seated in a pivotable manner in the housing (G) and exerts a force on the intermediate member (Z), which moves this towards the cam (N).

Figure 9:
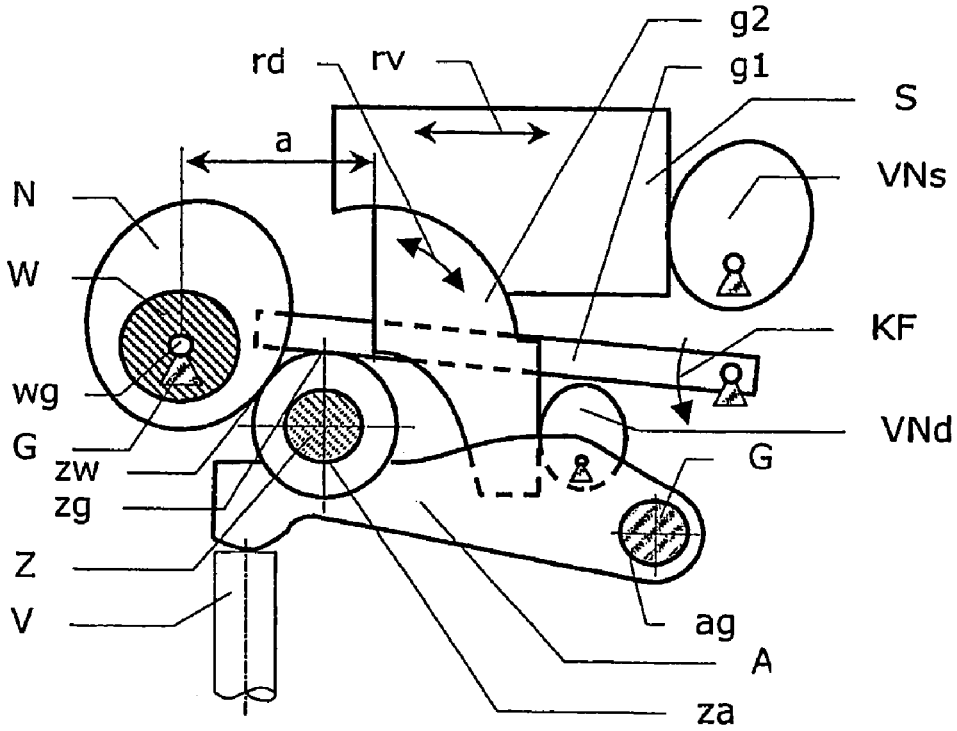
Figure 10:
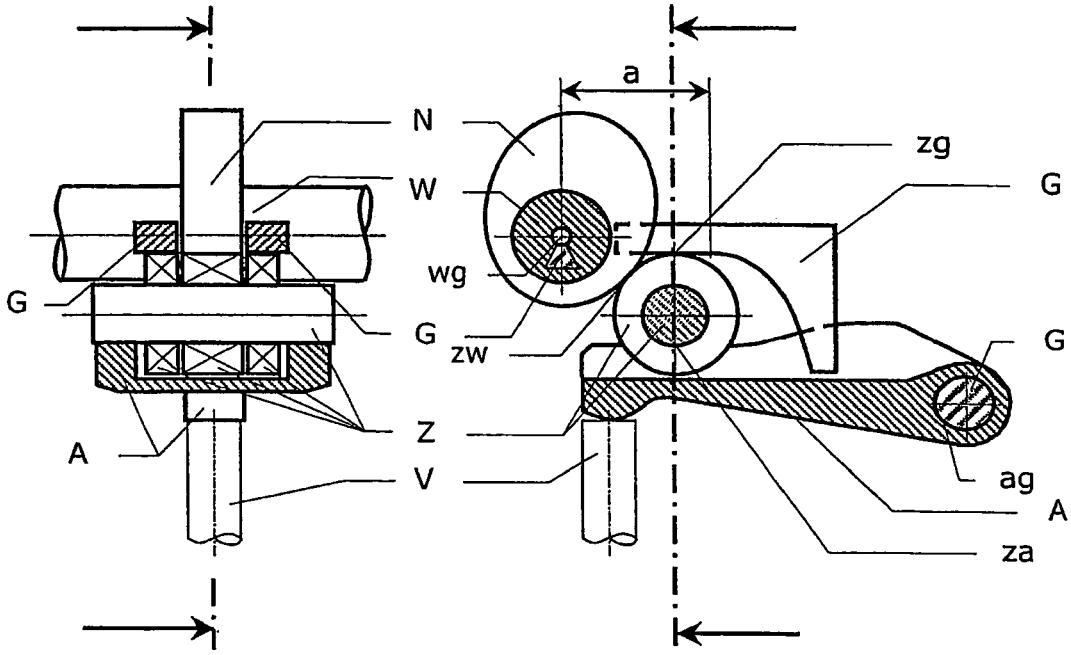

This force is created for example via a spring force (KF). With this type of design, the necessary spring travel can be very small (FIG. 9).

The invention claimed is:

1. A device for the variable actuation of the gas exchange valves in internal combustion piston engines, comprising: a housing (G), a shaft (W) seated in the housing (G) in a pivotable manner, the movement of which comes from a crankshaft, an output member (A), which is guided in the housing (G) and transmits the movement to the gas exchange valve (V) and an intermediate member (Z), which is connected with the shaft (W) and with the housing (G) via exactly one curved joint (zw, zg) and with the output member (A) via an additional joint (za), whereby a cam in the curved joint (zg) between the intermediate member (Z) and the housing (G) has a locking section and a controlling section, the position of the controlling section being set to the shaft (W) for the modification of the valve cam, the joint (za) between the intermediate member (Z) and the output member (A) being a curved joint such that the intermediate member (Z) may undergo rocking motion relative to the output member (A).

2. The device in accordance with claim 1, wherein one of the contours (Kaz, Kza) forming the curved joint (za) between the intermediate member (Z) and the output member (A) is formed on the intermediate member (Z) and on the output member (A) via an even contour.

3. The device in accordance with claim 2, wherein the curved joint (zg) between the intermediate member (Z) and the housing (G) is formed via a revolvable rotating body mounted in the housing (G) and via a cam (Kzg1) on the intermediate member (Z).

4. The device in accordance with claim 2, wherein the curved joint (zg) between the intermediate member (Z) and the housing (G) is formed via a revolvable rotating body attached on the intermediate member (Z) and via a cam (Kgz2) in the housing (G).

5. The device in accordance with claim 2, wherein the curved joint (zw) between the intermediate member (Z) and the shaft (W) is formed via a revolvable rotating body attached on the intermediate member (Z) and via a cam (Kwz1) on the shaft (W).

6. The device in accordance with claim 2, wherein the curved joint (zw) between the intermediate member (Z) and the output member (A) is formed via a revolvable rotating body attached on the intermediate member (Z) and via a cam (Kaz1) on the output member (A).

7. The device in accordance with claim 1, wherein at least one of the contours (Kaz, Kza) forming the curved joint (za) between the intermediate member (Z) and the output member (A) is formed on the intermediate member (Z) and the output member (A) via a segment of a revolvable rotating body.

8. The device in accordance with claim 7, wherein the curved joint (zg) between the intermediate member (Z) and the housing (G) is formed via a revolvable rotating body mounted in the housing (G) and via a cam (Kzg1) on the intermediate member (Z).

9. The device in accordance with claim 7, wherein the curved joint (zg) between the intermediate member (Z) and the housing (G) is formed via a revolvable rotating body attached on the intermediate member (Z) and via a cam (Kgz2) in the housing (G).

10. The device in accordance with claim 7, wherein the curved joint (zw) between the intermediate member (Z) and the shaft (W) is formed via a revolvable rotating body attached on the intermediate member (Z) and via a cam (Kwz1) on the shaft (W).

11. The device in accordance with claim 1, wherein the curved joint (zg) between the intermediate member (Z) and the housing (G) is formed via a revolvable rotating body mounted in the housing (G) and via a cam (Kzg1) on the intermediate member (Z).

12. The device in accordance with claim 11, wherein at least two of the curved joints on the intermediate member (Z) are formed via revolvable rotating bodies.

13. The device in accordance with claim 12, wherein at least two of the rotating centers of the revolvable rotating bodies attached at the intermediate member (Z) overlap.

14. The device in accordance with claim 12, wherein the cam forming the curved joint (zg) between the intermediate member (Z) and housing (G) is represented via a contour forming the section in the housing or on a part (g1) mounted in the housing and via a contour forming the controlling section on another part (g2).

15. The device in accordance with claim 11, wherein at least one of the revolvable rotating bodies attached at the intermediate member (Z) is formed via a part of an anti-friction bearing.

16. The device in accordance with claim 1, wherein the curved joint (zg) between the intermediate member (Z) and the housing (G) is formed via a revolvable rotating body attached on the intermediate member (Z) and via a cam (Kgz2) in the housing (G).

17. The device in accordance with claim 1, wherein the curved joint (zw) between the intermediate member (Z) and the shaft (W) is formed via a revolvable rotating body attached on the intermediate member (Z) and via a cam (Kwz1) on the shaft (W).

18. The device in accordance with claim 17, wherein the radial cam forming the curved joint (zg) between the intermediate member (Z) and the housing (G) is modifiable with respect to displacement and rotation.

19. The device in accordance with claim 1, wherein the curved joint (zw) between the intermediate member (Z) and the output member (A) is formed via a revolvable rotating body attached on the intermediate member (Z) and via a cam (Kaz1) on the output member (A).

20. The device in accordance with claim 1, wherein two or more valves (Vi) of a cylinder are actuated from the intermediate member (Z) via one or more said output members (Ai).

* * * * *